US006165662A

United States Patent [19]

Kato et al.

[11] Patent Number: 6,165,662

[45] Date of Patent: Dec. 26, 2000

[54] ELECTROPHOTOGRAPHIC PHOTORECEPTOR

[75] Inventors: Satoshi Kato; Itaru Ogawa, both of Kanagawa, Japan

[73] Assignee: Mitsubishi Chemical Corporation, Tokyo, Japan

[21] Appl. No.: 09/451,773

[22] Filed: Dec. 1, 1999

[30] Foreign Application Priority Data

Dec. 2, 1998 [JP] Japan ..... 10-342703

[51] Int. Cl.[7] ..... G03G 5/04

[52] U.S. Cl. ..... 430/96; 430/59.6

[58] Field of Search ..... 430/59.6, 96

[56] References Cited

U.S. PATENT DOCUMENTS

| | | | |
|---|---|---|---|
| 5,246,807 | 9/1993 | Kanemaru et al. | 430/96 |
| 5,254,423 | 10/1993 | Mayama et al. | 430/96 |
| 5,283,142 | 2/1994 | Mayama et al. | 430/59.6 |
| 5,418,099 | 5/1995 | Mayama et al. | 430/59.6 |
| 5,876,888 | 3/1999 | Anayama et al. | 430/96 |
| 5,876,892 | 3/1999 | Fujimori et al. | 430/59.6 |

FOREIGN PATENT DOCUMENTS

| | | | |
|---|---|---|---|
| 5-72753 | 3/1993 | Japan | 430/59.6 |

*Primary Examiner*—Roland Martin
*Attorney, Agent, or Firm*—Oblon, Spivak, McClelland, Maier & Neustadt, P.C.

[57] ABSTRACT

An electrophotographic photoreceptor having a photosensitive layer containing a binder resin on an electroconductive substrate, wherein at least a part of the binder resin in the photosensitive layer is a polycarbonate resin having a structure of the following formula (1) as main repeating units and a structure of the following formula (2) at one or each terminal and having a viscosity-average molecular weight of from 10,000 to 300,000:

(1)

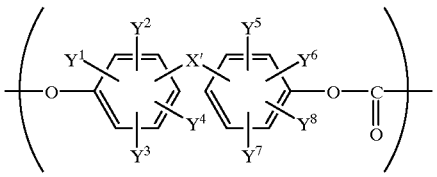

-continued (2)

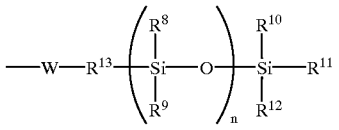

where, in the formula (1), each of $Y^1$ to $Y^8$ which are independent of one another, is a hydrogen atom, a $C_{1-10}$ saturated aliphatic hydrocarbon group, a $C_{3-10}$ unsaturated aliphatic hydrocarbon group, a halogen atom, a halogenated alkyl group, a $C_{1-10}$ alkoxy group or a $C_{6-20}$ aromatic hydrocarbon group which may be substituted, $X^1$ is

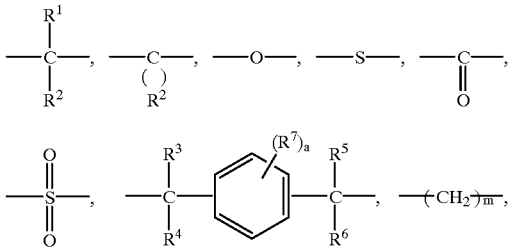

an aromatic ring, a single bond, a lactone or fluorene, each of $R^1$ to $R^7$ which are independent of one another, is a hydrogen atom, a $C_{1-10}$ saturated aliphatic hydrocarbon group which may have a substituent, a $C_{3-10}$ unsaturated aliphatic hydrocarbon group which may have a substituent, a halogen atom, an alkoxy group or a $C_{6-20}$ aromatic hydrocarbon group which may have a substituent, Z is a $C_{3-20}$ substituted or unsubstituted aliphatic hydrocarbon group, a is an integer of from 0 to 4, l is an integer of from 1 to 6, and m is an integer of from 2 to 20, and, in the formula (2), $R^{13}$ is an aliphatic and/or aromatic bivalent organic residue, W is a single bond, O, CO, COO, NH, NHCO, S, SO or $SO_2$, each of $R^8$ to $R^{12}$ which are independent of one another, is a $C_{1-10}$ saturated aliphatic hydrocarbon group which may have a substituent or a $C_{6-20}$ aromatic hydrocarbon group which may have a substituent, and n is an integer of from 1 to 500.

11 Claims, No Drawings

ELECTROPHOTOGRAPHIC PHOTORECEPTOR

BACKGROUND OF THE INVENTION

1. Field of the Invention

The present invention relates to an electrophotographic photoreceptor. More particularly, it relates to an electrophotographic photoreceptor which is excellent in surface smoothness, abrasion resistance and electrical properties.

2. Discussion of Background

In recent years, electrophotography has been widely used and applied not only in the field of copying machines but also in the field of various printers, by virtue of instantaneous and high quality of images thereby obtainable. With respect to a photoreceptor which is essential to the electrophotography, an inorganic photoconductor such as selenium, an arsenic-selenium alloy, cadmium sulfide or zinc oxide has heretofore been used as its photoconductive material, and recently, a photoreceptor employing an organic photoconductive material has been developed which has a merit such that the layer-forming is easy without environmental pollution, and the production is easy.

Among organic photoreceptors, a so-called laminate type photoreceptor having a charge generation layer and a charge transport layer laminated, has been devised and is being intensively studied.

The laminated type photoreceptor has a possibility that it will be employed as the main photoreceptor, since a highly sensitive photoreceptor can be obtained by a combination of a highly efficient charge generation material and a highly efficient charge transport material, the range for selection of materials is wide and a highly safe photoreceptor can be obtained, and since the coating productivity is high and it is relatively advantageous also from the viewpoint of costs. Accordingly, it is actively being developed.

However, conventional organic laminate type photoreceptors have been inadequate in the physical strength of the surface of the photoreceptors, whereby printing resistance has been practically limited, although they exhibit adequate performance in the electrical properties such as the sensitivity and electrification properties. It is the mechanical properties of the charge transport layer in a laminate type photoreceptor that substantially determines the physical strength of the surface of the photoreceptor.

In order to increase the mechanical strength, it has been proposed heretofore, for example, to provide an overcoating layer (JP-A-61-72256) or to use a binder polymer having a high abrasion resistance (JP-A-63-148263 and JP-A-3-221962). However, such proposals have been inadequate in the intended effects or have had a problem that they tend to adversely affect the properties such as electrical properties.

Further, in recent years, along with improvement of the image quality, a photoreceptor having excellent surface smoothness has been desired. In order to improve the surface smoothness, it has been proposed, for example, to employ a polysiloxane block copolymer as a binder (JP-A-61-132954 and JP-A-2-240655), to employ a polysiloxane terminal compound having a low molecular weight (JP-A-7-261440), or to employ a fluorine atom-containing polycarbonate (JP-A-5-306335, JP-A-6-32884, and JP-A-6-282094). However, such proposals have been inadequate in the intended effects or have had a problem that they tend to adversely affect the electrical properties or the printing resistance.

SUMMARY OF THE INVENTION

It is an object of the present invention to improve the smoothness of the surface of the photoreceptor without adversely affecting the electrical properties or the printing resistance.

Under these circumstances, the present inventors have conducted an extensive study and as a result, they have found it possible to substantially improve the surface smoothness of a photosensitive layer without impairing other properties by incorporating a polycarbonate resin having a polysiloxane at its terminals and having a certain specific molecular weight, to the photosensitive layer, and have invented an electrophotographic photoreceptor which undergoes little abrasion even by repeated use for a long period of time and which is excellent in the cleaning property and the durability against scratching.

Namely, the present invention provides an electrophotographic photoreceptor having a photosensitive layer containing a binder resin on an electroconductive substrate, wherein at least a part of the binder resin in the photosensitive layer is a polycarbonate resin having a structure of the following formula (1) as main repeating units and a structure of the following formula (2) at one or each terminal and having a viscosity-average molecular weight of from 10,000 to 300,000:

(1)

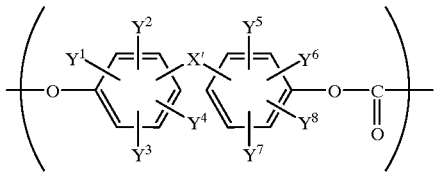

(2)

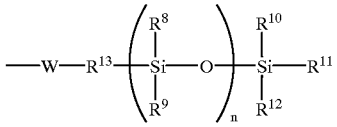

where, in the formula (1), each of $Y^1$ to $Y^8$ which are independent of one another, is a hydrogen atom, a $C_{1-10}$ saturated aliphatic hydrocarbon group, a $C_{3-10}$ unsaturated aliphatic hydrocarbon group, a halogen atom, a halogenated alkyl group, a $C_{1-10}$ alkoxy group or a $C_{6-20}$ aromatic hydrocarbon group which may be substituted, $X^1$ is

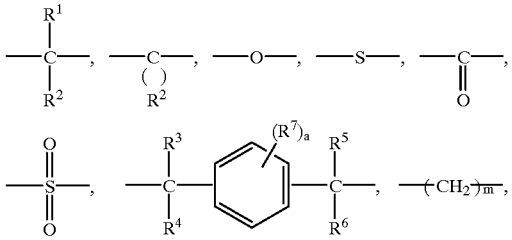

an aromatic ring, a single bond, a lactone or fluorene, each of $R^1$ to $R^7$ which are independent of one another, is a hydrogen atom, a $C_{1-10}$ saturated aliphatic hydrocarbon group which may have a substituent, a $C_{3-10}$ unsaturated aliphatic hydrocarbon group which may have a substituent, a halogen atom, an alkoxy group or a $C_{6-20}$ aromatic hydrocarbon group which may have a substituent, Z is a $C_{3-20}$ substituted or unsubstituted aliphatic hydrocarbon group, a is an integer of from 0 to 4, l is an integer of from 1 to 6, and m is an integer of from 2 to 20, and, in the formula (2), $R^{13}$ is an aliphatic and/or aromatic bivalent organic residue, W is a single bond, O, CO, COO, NH, NHCO, S, SO or $SO_2$, each of $R^8$ to $R^{12}$ which are independent of one another, is a $C_{1-10}$ saturated aliphatic hydrocarbon group which may have a substituent or a $C_{6-20}$ aromatic hydrocarbon group which may have a substituent, and n is an integer of from 1 to 500.

DETAILED DESCRIPTION OF THE PREFERRED EMBODIMENTS

Now, the present invention will be described in detail.

In the above formula (1), $X^1$ is preferably

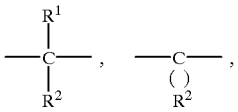

or

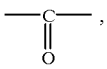

and each of $R^1$ and $R^2$ is preferably a hydrogen atom, a methyl group, an ethyl group, a n-propyl group, an isopropyl group or a phenyl group, more preferably a methyl group or a phenyl group. Z is preferably a $C_{4-6}$ bivalent aliphatic hydrocarbon group, more preferably a $C_5$ bivalent aliphatic hydrocarbon group. Further, the substituent on the saturated aliphatic hydrocarbon group, the unsaturated aliphatic hydrocarbon group or the aromatic hydrocarbon group for each of $R^1$ to $R^8$ in the structures of $X^1$, may, for example, be a halogen atom. Each of $R^3$ to $R^7$ is preferably a hydrogen atom, a methyl group, an ethyl group or a phenyl group, a is preferably 0, 1 is preferably 1, and m is preferably from 2 to 4. Each of $Y^1$ to $Y^8$ is preferably a hydrogen atom, a chlorine atom, a bromine atom, a methyl group, an ethyl group, a n-propyl group, an isopropyl group, a sec-butyl group, a n-butyl group, an isobutyl group, a tert-butyl group, an allyl group or a phenyl group, more preferably a hydrogen atom or a methyl group.

The repeating units of the formula (1) may be of the same structure or a combination of repeating units of two or more different structures. Particularly preferred is a copolymer polycarbonate having the following two types of structures of the formulae (1a) and (1b) as repeating units:

(1a)

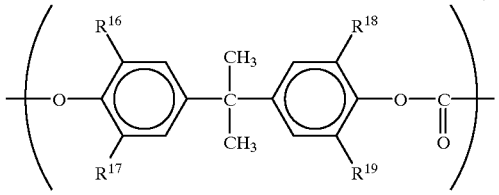

(1b)

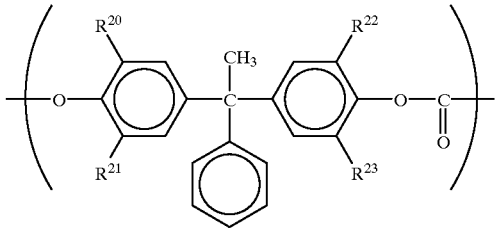

In the above formulae, each of $R^{16}$ to $R^{23}$ is a hydrogen atom or a $C_{1-4}$ alkyl group, provided that at least one among $R^{16}$ to $R^{19}$ is not a hydrogen atom. Preferably, each of $R^{16}$ to $R^{23}$ is a hydrogen atom or a methyl group, and more preferably, each of $R^{16}$ and $R^{18}$ is a methyl group, each of $R^{17}$ and $R^{19}$ is a hydrogen atom or a methyl group, each of $R^{20}$ and $R^{22}$ is a hydrogen atom or a methyl group, and each of $R^{21}$ and $R^{23}$ is a hydrogen atom. The ratio of (1a) to (1b) is not particularly limited, and it is usually selected within a range of from 10:90 to 90:10.

Further, other structures such as a polyester, a polyallylate, a polyamide, a polyurethane, a polyimide, a polyether and a polyvinyl, may be introduced within a range not to substantially change the properties.

In the above formula (2), each of $R^8$ to $R^{12}$, which are independent of one another, is a $C_{1-10}$ saturated aliphatic hydrocarbon group which may have a substituent, or a $C_{6-20}$ aromatic hydrocarbon group which may be substituted. Preferably, the $C_{1-10}$ saturated aliphatic hydrocarbon group may be an unsubstituted alkyl group such as a methyl group, an ethyl group, a n-propyl group, an isopropyl group, a n-butyl group, an isobutyl group, a sec-butyl group, a tert-butyl group, a n-pentyl group, a sec-pentyl group, a n-hexyl group, a n-heptyl group or a n-octyl group, and the $C_{6-20}$ aromatic hydrocarbon group which may be substituted, may, for example, be a phenyl group, a 4-methylphenyl group or a naphthyl group. Among them, a methyl group, an ethyl group or a phenyl group is particularly preferred. $R^{13}$ is an aliphatic and/or aromatic bivalent organic residue. Preferably, it is of the following structures:

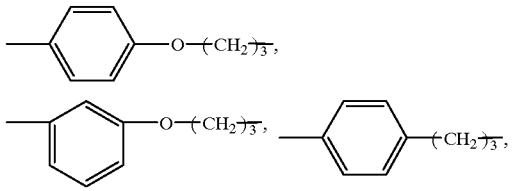

-continued

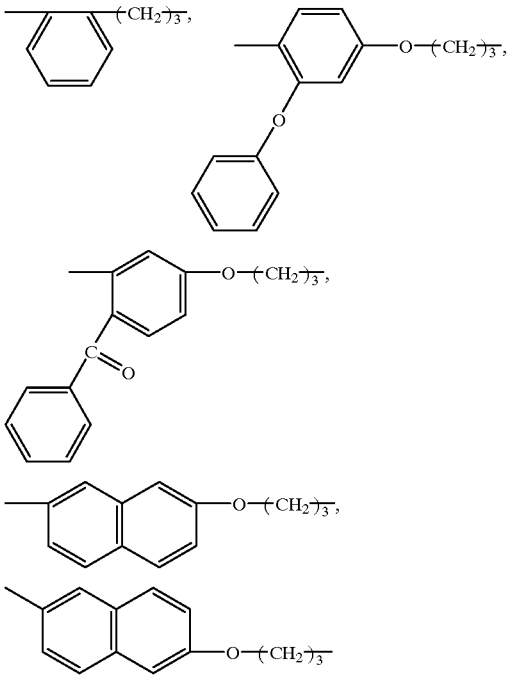

In the above formulae, the aromatic groups may be substituted or unsubstituted.

W is a single bond, O, CO, COO, NH, NHCO, S, SO or $SO_2$, preferably O or COO.

In the structures of the above formula (2) in the binder resin contained in the photosensitive layer of the electrophotographic photoreceptor of the present invention, polysiloxane moieties (moieties having W and $R^{13}$ removed from the structure of the formula (2)) are in an amount of from 0.01 to 5 wt %, preferably from 0.1 to 4 wt %, more preferably from 0.3 to 3.5 wt %, based on the total binder resin contained in the photosensitive layer. If the amount of polysiloxane moieties is less than 0.01 wt %, no adequate effect for improving the smoothness of the photoreceptor surface tends to be obtainable, and if it exceeds 5 wt %, there will be an adverse effect to the transparency and the electrical properties.

n is an integer of from 1 to 500, preferably an integer of from 10 to 200, more preferably an integer of from 10 to 100. If n is less than 10, the effect for improving the smoothness tends to be small, and if n is too large, the light transmittance of the charge transport layer tends to be low, such being undesirable.

The polycarbonate polymer containing a polysiloxane structure at its terminal, to be used for the electrophotographic photoreceptor of the present invention, usually has a viscosity-average molecular weight of from 10,000 to 300,000, preferably from 15,000 to 100,000, more preferably from 28,000 to 60,000. If the viscosity-average molecular weight is less than 10,000, the mechanical strength of the resin tends to be low. On the other hand, if it exceeds 300,000, and if such a polymer is to be used as a binder resin for an electrophotographic photoreceptor, it tends to be difficult to coat it in a proper thickness.

As a method for preparing the polycarbonate polymer of the present invention, a conventional polymerization method for polycarbonates may be employed. For example, it is possible to employ a method wherein a bifunctional hydroxy compound and phosgene are reacted for interfacial polycondensation, a method wherein a bifunctional hydroxy compound is added to chloroformate produced by reacting a bifunctional hydroxy compound and phosgene, for interfacial polycondensation, or a method wherein a bifunctional hydroxy compound is polymerized with a carbonic acid ester such as diphenyl carbonate by an ester exchange reaction.

Further, in the polymerization for the polycarbonate, a diamine such as piperadine, or an acid halide such as terephthalic acid chloride, isophthalic acid chloride, adipic acid chloride or sebacic acid chloride, may be present within a range not to substantially adversely affect the reaction, or a branching agent represented by a polyhydric phenol such as pholoroglucinol, 1,1,1-tri(4-hydroxyphenyl)ethane or tetra(4-hydroxyphenyl)methane, may be present within a range not to bring about gelation.

As a method for producing a polycarbonate containing polysiloxane structures at its terminals, a method may be employed wherein polymerization is carried out in the presence of a polysiloxane containing a monofunctional phenol structure. As such a monofunctional phenol, one having a polysiloxane bonded thereto, may be present alone in the polymerization system, or it may be employed together with another monofunctional phenol such as p-tert-butyl phenol, phenol, cumyl phenol, octyl phenol or nonyl phenol. Otherwise, as another method, such a polycarbonate can be produced also by a hydrosilylation reaction of a polysiloxane having a Si-H structure at one terminal to a polycarbonate having a carbon-carbon double bond at its terminal.

The polycarbonate to be used for the electrophotographic photoreceptor of the present invention, may be a polycarbonate containing a polysiloxane of the formula (2) in one or each terminal group of every polycarbonate to be used, or a composition comprising a polycarbonate containing no polysiloxane structure and a polycarbonate containing the polysiloxane structure in one or each terminal group. The polysiloxane moieties in the above formula (2) contained in the photosensitive layer of the electrophotographic photoreceptor of the present invention, are determined by the structure of the formula (2) and the content of the binder in the photosensitive layer, and they are preferably from 0.01 to 4 wt %, more preferably from 0.1 to 2 wt %. If they are less than 0.01 wt %, no adequate effect for improving the smoothness of the photoreceptor surface tends to be obtainable, and if they exceed 4 wt %, there will be an adverse effect to the transparency and the electrical properties. In the case of the composition comprising the polycarbonate containing no polysiloxane moiety and the polycarbonate containing polysiloxane moieties, the ratio of the polysiloxane moieties in the total binder resin should be within the above range.

In the present invention, the photosensitive layer is formed on an electroconductive support. The electroconductive support may be made of a metal material such as aluminum, an aluminum alloy, stainless steel, copper or nickel or a resin material having electroconductivity imparted by an addition of an electroconductive powder of e.g. a metal, carbon or tin oxide. Or, it may be a resin, glass or paper having an electroconductive material such as aluminum, nickel or ITO (indium oxide/tin oxide alloy) vapor-deposited or coated on its surface. With respect to the shape, it may be of a drum, sheet or belt shape. Further, it may be one having a conductive material having a proper resistivity coated on an electroconductive support of a metal material to control the electroconductivity he surface property, etc., or to cover defects.

In a case where a metal material such as an aluminum alloy is to be used as the electroconductive support, it may be subjected to anodic oxidation treatment or chemical conversion treatment before use. If the anodic oxidation treatment is applied, it is advisable to apply a sealing treatment in accordance with a conventional method.

Between the electroconductive support and the photosensitive layer, an undercoating layer may be provided in order to improve the adhesion, the blocking property, etc.

As such an undercoating layer, a resin or one having particles of e.g. a metal oxide dispersed in a resin, may be employed.

The particles to be used for the undercoating layer may, for example, be particles of a metal oxide containing one metal element, such as titanium oxide, aluminum oxide, silicon oxide, zirconium oxide, zinc oxide or iron oxide, particles of a metal oxide containing a plurality of metal elements, such as calcium titanate, strontium titanate or barium titanate, or particles of other than an oxide, such as silicon nitride or silicon carbide. One type of particles may be employed, or a plural types of particles may be mixed for use. Among these particles, metal oxide particles are preferred. Titanium oxide or aluminum oxide is more preferred. Particularly preferred is titanium oxide. Titanium oxide particles may have an inorganic substance such as tin oxide, aluminum oxide, antimony oxide, zirconium oxide or silicon oxide, or an organic substance such as an aliphatic carboxylic acid, a polyol, a polysiloxane or an organic silane, applied on its surface. The crystal system of titanium oxide particles may be any one of rutile, anatase, brookite and amorphous. A plurality of crystal states may be contained.

Further, with respect to the particle size of metal oxide particles, particles of various particle sizes may be employed. Among them, from the viewpoint of the properties and the stability of the coating fluid, particles having an average primary particle size of from 10 to 100 nm, are preferred. Particularly preferred are those having an average primary particle size of from 10 to 25 nm.

The undercoating layer is preferably formed in a state where the metal oxide particles are dispersed in a binder resin. As the binder resin to be used for the undercoating layer, phenoxy, epoxy, polyvinyl pyrrolidone, polyvinyl alcohol, casein, polyacrylic acid, a cellulose, gelatin, starch, polyurethane, polyimide or polyamide, may be used alone or in a form cured together with a curing agent. Among them, an alcohol soluble copolymer polyamide or a modified polyamide is preferred as it exhibits excellent dispersibility and coating property.

The ratio of the inorganic particles to the binder resin in the undercoating layer can be optionally selected, but it is usually preferred to use them within a range of from 10 to 500 wt % from the viewpoint of the coating property and the stability of the dispersion.

The thickness of undercoating layer can be optionally selected, but it is preferably from 0.1 to 20 $\mu$m from the viewpoint of the coating property and the properties of the photoreceptor. Further, the undercoating layer may contain a conventional antioxidant, etc.

As a specific structure for the photosensitive layer of the present invention, a structure such as a laminated type photoreceptor wherein a charge generation layer comprising a charge generation material as the main component, and a charge transport layer comprising a charge transport material and a binder resin as the main components, are laminated in this order, or a dispersion type photoreceptor wherein a charge generation material is dispersed in a layer comprising a charge transport material and a binder resin, may be mentioned as an example of the basic form.

In the case of the laminated type photoreceptor, various photoconductive materials including inorganic photoconductive materials such as selenium and its alloys, cadmium sulfide, etc., and organic pigments such as a phthalocyanine pigment, an azopigment, a quinacridone pigment, an indigo pigment, a perylene pigment, a polycyclic quinone pigment, an anthanthrone pigment and a benzimidazole pigment, can be used as the charge generation material for the charge generation layer. Particularly, organic pigments are preferred, and more particularly, a phthalocyanine pigment and an azo pigment are preferred. Fine particles of such a charge generation material are used in a form bound by various binder resins such as a polyester resin, a polyvinyl acetate, a polyacrylate, a polymethacrylate, a polyester, a polycarbonate, a polyvinyl acetoacetal, a polyvinyl propional, a polyvinyl butyral, a phenoxy resin, an epoxy resin, an urethane resin, a cellulose ester and a cellulose ether. The ratio of such particles is selected usually within a range of from 30 to 500 parts by weight, per 100 parts by weight of the binder resin, and the thickness of the charge generation layer is usually from 0.1 to 2 $\mu$m.

When a phthalocyanine compound is employed as the charge generation material, it may specifically be nonmetal phthalocyanine or a phthalocyanine having a metal such as copper, indium, gallium, tin, titanium, zinc, vanadium, silicon or germanium, or its oxide or halide, coordinated thereto. The ligand to the trivalent or higher valent metal atom may, for example, be a hydroxyl group or an alkoxy group in addition to the above-mentioned oxygen atom or chlorine atom. Particularly preferred is highly sensitive X-type or $\tau$-type nonmetal phthalocyanine, oxytitanium phthalocyanine, vanadyl phthalocyanine, chloroindium phthalocyanine, chlorogallium phthalocyanine, hydroxygallium phthalocyanine or hydroxysilicon phthalocyanine. Further, oxytitanium phthalocyanine of various crystal forms may be employed, including those identified by I-phase and II-phase by W. Heller et at. (Zeit. Kristallogr. 159 (1982) 173) and a crystal form showing a distinct peak at a diffraction angle $2\theta \pm 0.2°$ of 27.3° in a powder X-ray diffraction using CuK $\alpha$-ray. Phthalocyanine compounds may be used alone or in combination as a mixture of two or more of them.

The charge transport material contained in the charge transport layer may, for example, be an aromatic nitro compound such as 2,4,7-trinitrofluorenone, a heterocyclic compound such as a carbazole derivative, an indole derivative, an imidazole derivative, an oxadiazole derivative, a pyrazole derivative, an oxadiazole derivative, a pyrazoline derivative or a thiazole derivative, or a known compound such as an aniline derivative, a hydrazone derivative, an aromatic amine derivative, a stilbene derivative, a butadiene derivative, an enamine derivative or one having a plurality of these compounds bonded, or a polymer having groups made of such compounds, in the main chain or side chains. Among them, particularly preferred is a triarylamine derivative, a hydrazone compound, a stilbene derivative or a butadiene derivative. These charge transport materials may be used alone or in combination as a mixture of two or more of them. The charge transport layer is formed in a form wherein such a charge transport material is bonded to a binder resin. The charge transport layer may be made of a single layer or a laminate having a plurality of layers different in the constituting components or in the compositional ratios laminated one on another.

The ratio of the charge transport material to the binder resin is usually within a range of from 30 to 200 parts by weight, preferably from 40 to 150 parts by weight, per 100 parts by weight of the binder resin. The thickness of the charge transport layer is usually from 5 to 100 $\mu$m, preferably from 10 to 50 $\mu$m, more preferably from 15 to 45 $\mu$m. To the charge transport layer, known additives such as a plasticizer, an antioxidant, an ultraviolet absorber, an electron attractive compound and a leveling agent, may be incorporated in order to improve the film-forming property, flexibility, coating property, antifauling property, gas resistance or light resistance.

The antioxidant may, for example, be a hindered phenol compound or a hindered amine compound.

In the case of the dispersion type, it is preferred that the charge generation material is used within a range of from 1 to 50 parts by weight, and the charge transport material is used within a range of from 30 to 150 parts by weight, per 100 parts by weight of the binder resin. The thickness of the dispersion type photosensitive layer is usually from 5 to 100 $\mu$m, preferably from 10 to 50 $\mu$m. Further, various additives such as an antioxidant and a sensitizer may be incorporated as the case requires.

In the case of the dispersion type photosensitive layer, the above-mentioned charge generation material is dispersed in the charge transport medium having the above-mentioned composition.

In such a case, the particle size of the charge generation material is required to be sufficiently small, preferably at most 1 $\mu$m, more preferably at most 0.5 $\mu$m. If the amount of the charge generation material dispersed in the photosensitive layer is too small, no adequate sensitivity can be obtained, and if it is too large, there will be a trouble such as a decrease in electrification or a deterioration in the sensitivity. Accordingly, it is used preferably within a range of from 0.5 to 50 wt %, more preferably within a range of from 1 to 20 wt %. Also in this case, a known plasticizer to improve the film-forming property, flexibility or mechanical strength, an additive to control the residual potential, a dispersion assistant to improve the dispersion stability, a leveling agent, a surfactant or other additive such as silicon oil or fluorine type oil, to improve the coating property, may be incorporated.

A protective layer may be provided on the photosensitive layer for the purpose of preventing abrasion of the photosensitive layer or preventing or reducing deterioration of the photosensitive layer due to e.g. a discharge product generated from e.g. an electrifying device.

Further, the surface layer may contain a fluorine resin, a silicone resin or the like for the purpose of reducing abrasion or frictional resistance of the photoreceptor surface. Otherwise, it may contain particles made of such a resin or particles of an inorganic compound.

The photoreceptor of the present invention may have any one of the above-described layer structures. However, it is preferred that the polycarbonate resin having the structure of the formula (2) at the terminal, is contained in the surface layer of the photoreceptor. Here, the surface layer represents the entire photosensitive layer in the case of a single layer type (the dispersion type), the charge transport layer in the case of the laminated type, or the protective layer when the protective layer is provided. A laminated type photoreceptor is particularly preferred from the viewpoint of the electrical properties.

Each of these layers constituting the photoreceptor is formed on the support by dip coating, spray coating, nozzle coating, bar coating, roll coating or blade coating. As a method for forming the respective layers, a known method may be employed such that coating fluids prepared by dissolving or dispersing the substances to be contained in the respective layers, in a solvent, are sequentially coated.

An electrophotographic apparatus such as a copying machine or a printer employing the electrophotographic photoreceptor of the present invention, includes at least electrification, exposure, development and transfer processes. The respective processes can be carried out by conventional methods. For the electrification (electrical charging device), for example, corotoron or scorotoron electrification utilizing corona discharge, or contact electrification by means of a conductive roller, brush or film, may be employed. As an electrification method employing corona discharge, scorotoron electrification is used in many cases in order to maintain dark potential to be constant. As a developing method, it is common to employ a method of developing by contacting or not-contacting a magnetic or non-magnetic one component developer or two-component developer. As a transfer method, a method employing corona discharge, or a method employing a transfer roller or a transfer belt, may be employed. The transfer may be carried out directly on paper or OHP film, or may be carried out once on an intermediate transfer means (belt-type or drum-type) and then on paper or OHP film.

Usually, a fixing process for fixing the developer to the paper is employed after the transfer. As the fixing means, heat fixing or pressure fixing which is commonly employed, may be used.

In addition to these processes, a process which is commonly employed, such as cleaning or antistatic process, may be included.

Now, the present invention will be described in further detail with reference to Examples. However, it should be understood that the present invention is by no means restricted by such specific Examples.

EXAMPLE 1

| Preparation of polycarbonate | |
|---|---|
| 1-(1) Preparation of Bisphenol C Oligomer | |
| 2,2-Bis(4-hydroxy-3-methylphenyl)propane (= bisphenol C) | 100 parts |
| Sodium hydroxide | 76 parts |
| Water | 922 parts |
| Methylene chloride | 412 parts |

The above mixture was charged into a reactor equipped with a stirrer and stirred. Then, 83 parts of phosgene was blown into the mixture to carry out the reaction. After completion of the reaction, only the methylene chloride solution containing the polycarbonate oligomer was collected. The analytical results of the obtained methylene chloride solution of the oligomer were as follows.

| | |
|---|---|
| Oligomer concentration (Note 1) | 18.0 wt % |
| Terminal chloroformate group concentration (Note 2) | 0.47N |
| Terminal phenolic hydroxyl group concentration (Note 3) | 0.28N |

(Note 1): The oligomer concentration was measured after evaporation to dryness.
(Note 2): An aniline hydrochloride obtained by reacting with aniline was subjected to neutralization titration with a 0.1N sodium hydroxide aqueous solution.
(Note 3): The color development when the solution was dissolved in a solution comprising methylene chloride, titanium tetrachloride and acetic acid, was measured by colorimetry at 546 nm.

1-(2) Preparation of Bisphenol P Oligomer

The preparation was carried out in the same manner as in 1-(1) except that the following composition was employed by using 1,1-bis(4-hydroxyphenyl)-1-phenylethane (=bisphenol P) instead of bisphenol C in 1-(1).

| | |
|---|---|
| 1,1-Bis (4-hydroxyphenyl)-1-phenyl ethane (= bisphenol P) | 100 parts |

-continued

| | |
|---|---|
| Sodium hydroxide | 45 parts |
| Water | 1080 parts |
| Methylene chloride | 421 parts |

The analytical results of the obtained methylene chloride solution of the oligomer were as follows.

| | |
|---|---|
| Oligomer concentration | 21.6 wt % |
| Terminal chloroformate group concentration | 0.18N |
| Terminal phenolic hydroxyl group concentration | 0.025N |
| 1-(3) Polymerization of Polycarbonate | |
| Bisphenol C oligomer solution obtained in 1-(1) | 116 l |
| Bisphenol P oligomer solution obtained in 1-(2) | 91 l |
| Methylene chloride | 34 l |
| 4-tert-Butylphenol (PTBP) | 0.114 kg |
| 2-Benzoyl-5-(3-polydimethylsiloxanepropoxy)phenol (average polymerization degree n of polysiloxane = 38) | 0.5 kg |

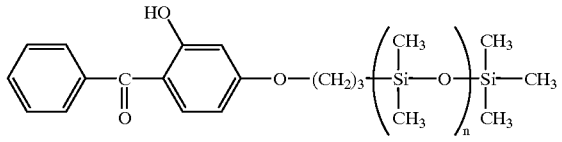

56.4 l of water and 10.02 g of triethylamine were charged into a polymerization reactor equipped with a stirrer and stirred at 20° C. Then, 15.83 l of a 25 wt % sodium hydroxide aqueous solution was added thereto, followed by interfacial polymerization for 7 hours.

Then, 80 l of water and 450 kg of methylene chloride were added thereto, and the mixture was stirred for 30 minutes, whereupon the reaction mixture was subjected to liquid separation. A methylene chloride solution containing the polycarbonate resin was washed with an aqueous sodium hydroxide solution, an aqueous hydrochloric acid solution and deionized water, and finally, methylene chloride was evaporated to obtain the resin, which was confirmed by $^1$H-NMR to be a terminal polysiloxane polycarbonate having the following structural formula (A):

Structural formula (A)

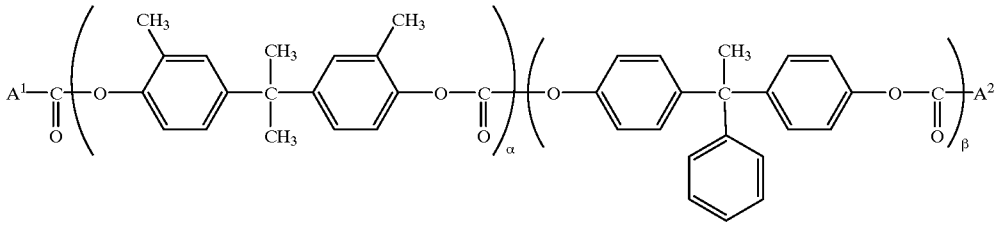

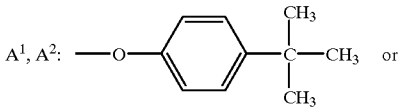

-continued

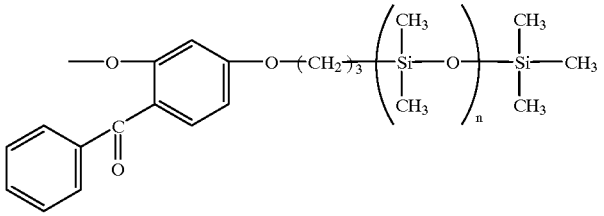

The viscosity-average molecular weight (Note 4) of this resin was 31,600.

(Note 4): Measurement of the viscosity-average molecular weight.

A sample was dissolved in methylene chloride to obtain a solution having a concentration C of 6.00 g/l. Using a Ubbellohde capillary viscometer whereby the flowdown time $t_0$ of the solvent (methylene chloride) was 136.21 seconds, the flowdown time t of the sample solution was measured in a constant temperature water tank set at 20.0° C. The viscosity-average molecular weight $M_v$ was calculated in accordance with the following formulae:

$$a=0.438\times\eta_{sp}+1$$

$$b=100\times\eta_{sp}/C$$

$$\eta_{sp}=t/t_0-1$$

$$C=6.00\cdot(g/l)$$

$$\eta=b/a$$

$$M_v=3207\times\eta^{1.205}$$

Preparation of photoreceptor 10 parts by weight of oxytitanium phthalocyanine was added to 150 parts by weight of 4-methoxy-4-methyl-2-pentanone, followed by pulverizing and dispersing treatment by a sandgrind mill.

Further, 100 parts of a 1,2-dimethoxyethane solution containing 5% of polyvinylbutyral (Denkabutyral #6000C, tradename, Denki Kagaku Kogyo K.K.) and 100 parts of 1,2-dimethoxyethane solution containing 5% of a phenoxy resin (PKHH, tradename, manufactured by Union Carbide Co.) were mixed to obtain a binder solution. To 160 parts by weight of the previously prepared pigment dispersion, 100 parts by weight of the binder solution and a suitable amount of 1,2-dimethoxyethane were added to obtain a dispersion having a final solid content concentration of 4.0%.

The dispersion thus obtained was coated on a polyethylene terephthalate film having aluminum vapor-deposited on its surface, so that the layer thickness would be 0.2 μm, to form a charge generation layer.

Then, on this film, a liquid obtained by dissolving 56 parts of the following hydrazone compound (1), 14 parts of the following hydrazone compound (2), 1.5 parts of the following cyano compound, 100 parts of the above-mentioned terminal polysiloxane polycarbonate resin having a structure of the structural formula (A) and 4 parts of Irganox 1076 having the following structure as an antioxidant, in a solvent mixture of dioxane and tetrahydrofuran, was coated and dried at 125° C. for 24 hours to form a charge transport layer so that the layer thickness after drying would be 18 μm.

Ka 12 (p. 23)

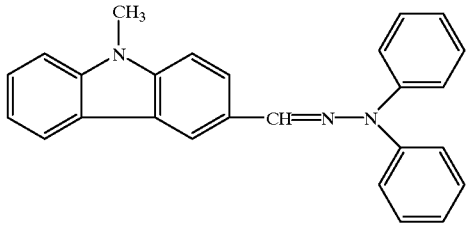

Hydrazone compound (1)

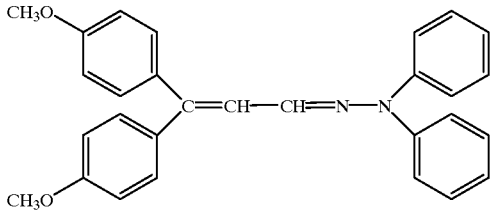

Hydrazone compound (2)
1.5 parts

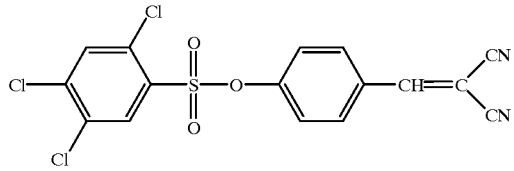

Cyano compound

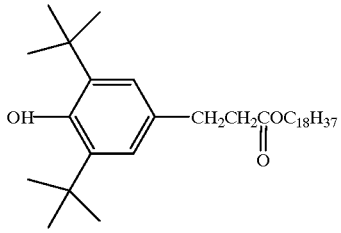

Cyano compound

Friction test

A toner was uniformly applied on the photoreceptor prepared as described above, so that it would be 0.1 mg/cm$^2$, and as a contact surface, a urethane rubber of the same material as a cleaning blade, cut to have a width of 1 cm, was employed. At an angle of 45°, the urethane rubber was moved three times with a stroke of 20 mm under a load of 200 g at a speed of 5 mm/sec, whereby the coefficient of dynamic friction of the third time was measured by a fully automatic friction-abrasion tester DFPM-SS, manufactured by Kyowa Kaimen Kagaku K.K. The results are shown in Table 1.

Electrical properties

The photoreceptor prepared and described above, was mounted on a photoreceptor measuring machine (Model EPA-8100, manufactured by Kawaguchi Denki K.K.) and electrically charged by setting a current flowing into the aluminum surface so that the potential during the electrification would be 750±10V, followed by exposure and destaticization, whereby the half value exposure sensitivity $E_{1/2}$ at that time was measured. The results are shown in Table 1.

EXAMPLE 2

| Polymerization of polycarbonate | |
|---|---|
| Bisphenol C oligomer solution obtained in 1-(1) | 195 ml |
| Bisphenol P oligomer solution obtained in 1-(2) | 174 ml |
| Methylene chloride | 115 ml |
| 4-tert-Butylphenol (PTBP) | 0.196 g |
| 2-Benzoyl-5-(3-polydimethylsiloxanepropoxy)phenol (average degree of polymerization of polysiloxane = 46) | 2.0 g |
| Water | 97 ml |
| Triethylamine | 0.02 ml |

The above mixture was charged into a 2 l separable flask and stirred at room temperature. Then, 48 ml of a 25 wt % sodium hydroxide aqueous solution was added thereto, followed by interfacial polymerization for 3 hours.

Then, 292 ml of water and 474 ml of methylene chloride were added thereto, and the mixture was stirred for 30 minutes, and then left to stand, so that the reaction mixture was subjected to liquid separation. A methylene chloride solution containing the polycarbonate resin was washed with an aqueous sodium hydroxide solution, an aqueous hydrochloric acid solution and deionized water, and finally, methylene chloride was evaporated to obtain a resin, which was confirmed by $^1$H-NMR to be a terminal polysiloxane polycarbonate of the above-mentioned structural formula (A). The viscosity-average molecular weight of this resin was 32,900.

A photoreceptor was prepared in the same manner as in Example 1 except that this resin was employed, and the coefficient of dynamic friction and the electrical properties were measured. The results are shown in Table 1.

EXAMPLE 3

Polymerization of polycarbonate

A terminal polysiloxane carbonate having the following structural formula (B) was polymerized in the same manner as in Example 2 except that 2.0 g of 2-benzoyl-5-(3-polydimethylsiloxanepropoxy)phenol in Example 2 was changed to 1.0 g of 2-(3-polydimethylsiloxanepropyl) phenol (average degree of polymerization=36), and the amount of 4-tert-butylphenol charged, was changed to 0.224 g. The viscosity-average molecular weight of this resin was 29,900.

Structural formula (B)

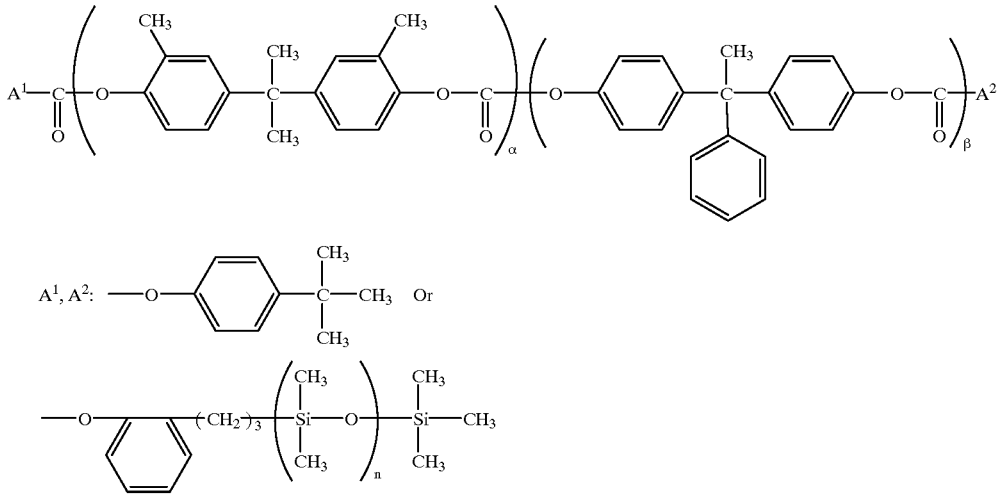

A photoreceptor was prepared in the same manner as in Example 1 except that this resin was employed, and the coefficient of dynamic friction and the electrical properties were measured. The results are shown in Table 1.

EXAMPLE 4

Polymerization of polycarbonate

The terminal polysiloxane polycarbonate of the above structural formula (B) was polymerized in the same manner as in Example 3 except that the amount of 2-(3-polydimethylsiloxanepropyl)phenol (average degree of polymerization=36) in Example 3 was changed from 1.0 g to 2.0 g, and the amount of 4-tert-butylphenol charged was changed to 0.175 g. The viscosity-average molecular weight of this resin was 30,200.

A photoreceptor was prepared in the same manner as in Example 1 except that this resin was employed, and the coefficient of dynamic friction and the electrical properties were measured. The results are shown in Table 1.

COMPARATIVE EXAMPLE 1

Polymerization of polycarbonate

A polycarbonate having the following structural formula (C) was polymerized in the same manner as in Example 1 except that the amount of 4-tert-butylphenol charged was changed to 0.138 kg, without charging 2-benzoyl-5-(3-polydimethylsiloxanepropoxy)phenol as used in Example 1. The viscosity-average molecular weight of this resin was 28,200.

Structural formula (C)

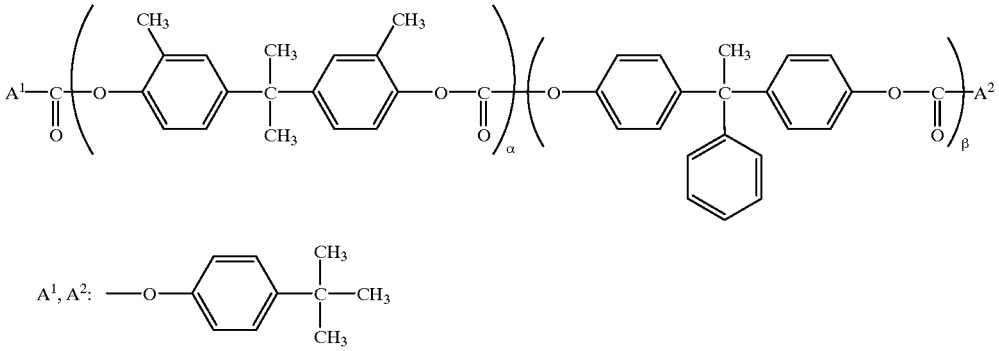

A photoreceptor was prepared in the same manner as in Example 1 except that this resin was employed, and the coefficient of dynamic friction and the electrical properties were measured. The results are shown in Table 1.

EXAMPLE 5

| Polymerization of polycarbonate | |
|---|---|
| Bisphenol C oligomer solution obtained in 1-(1) | 88 ml |
| Bisphenol P oligomer solution obtained in 1-(2) | 70 ml |
| Methylene chloride | 35 ml |
| 2-Benzoyl-5-(3-polymethylsiloxanepropoxy) phenol (average degree of polymerization of polysiloxane = 46) | 2.0 g |
| Water | 39 ml |
| Triethylamine | 0.08 ml |

The above mixture was charged into a 2 l separable flask and stirred at room temperature. Then, 19 ml of a 25 wt % sodium hydroxide aqueous solution was added thereto, followed by interfacial polymerization for 3 hours.

Then, 117 ml of water and 189 ml of methylene chloride were added thereto, and the mixture was stirred for 30 minutes and then left to stand, so that the reaction mixture was subjected to liquid separation. A methylene chloride solution containing the polycarbonate resin was washed with an aqueous sodium hydroxide solution, an aqueous hydrochloric acid solution and deionized water, and finally, methylene chloride was evaporated to obtain a resin, which was confirmed by $^1$H-NMR to be a terminal polysiloxane polycarbonate of the above-mentioned structural formula (A). The viscosity-average molecular weight of this resin was 39,000.

A photoreceptor was prepared in the same manner as in Example 1 except that this resin was employed, and the coefficient of dynamic friction and the electrical properties were measured. The results are shown in Table 1.

EXAMPLE 6

A photoreceptor was prepared in the same manner as in Example 1 except that instead of 100 parts of the terminal polysiloxane polycarbonate of the structural formula (A) produced in Example 1, 50 parts of the terminal polysiloxane polycarbonate of a structure of the structural formula (A) prepared in Example 1 and 50 parts of the polycarbonate of the structural formula (C) prepared in Comparative Example 1 were used, and the coefficient of dynamic friction of this photoreceptor was measured. The results are shown in Table 2.

Abrasion test

The photoreceptor film was cut into a circular shape with a diameter of 10 cm, and the abrasion was evaluated by a Taber abrasion tester (manufactured by Toyo Seiki). The test conditions were such that using an abrading ring CS-10F at 23° C. in an atmosphere with a relative humidity of 50%, the abrasion ring was rotated 1,000 times without any load (with the weight of the abrasion ring), whereupon the amount of abrasion was determined by comparing the weights before and after the test. The results are shown in Table 2.

COMPARATIVE EXAMPLE 2

Polymerization of polycarbonate

A terminal polysiloxane polycarbonate of the above structural formula (A) was polymerized in the same manner as in Example 2 except that the amount of 2-benzoyl-5-(3-polydimethylsiloanepropoxy)phenol charged for the polycarbonate in Example 2, was changed from 2.0 g to 1.0 g, and the amount of 4-tert-butylphenol charged was changed from 0.196 g to 5.29 g. The viscosity-average molecular weight of this resin was 9,100.

A photoreceptor was prepared in the same manner as in Example 6 except that in Example 6, instead of using 50 parts of the terminal polysiloxane carbonate of the structural formula (A) prepared in Example 1 and 50 parts of the polycarbonate of the structural formula (C) prepared in Example 1, 50 parts of the terminal polysiloxane polycarbonate of the above structural formula (A) having a viscosity-average molecular weight of 9,100 and 50 parts of the polycarbonate of the structural formula (C) prepared in Comparative Example 1, were used, and the measurement of the coefficient of dynamic friction and the abrasion test of this photoreceptor, were carried out. The results are shown in Table 2.

TABLE 1

| | Structure of binder resin | Content of polysiloxane moieties: As charged (wt %) | Content of polysiloxane moieties: As measured (Note 1) | Coefficient of dynamic friction | $E_{1/2}$ (ηJ/cm$^2$) | Vr (V) | DD (V) |
|---|---|---|---|---|---|---|---|
| Example 1 | (A) | 1.0 | 0.6 | 0.27 | 0.20 | 28 | 33 |
| Example 2 | (A) | 2.0 | 1.3 | 0.20 | 0.22 | 38 | 26 |
| Example 3 | (B) | 1.0 | 0.9 | 0.24 | 0.20 | 11 | 27 |
| Example 4 | (B) | 2.0 | 1.2 | 0.28 | 0.20 | 13 | 26 |
| Example 5 | (A) | 5.0 | 3.2 | 0.19 | 0.19 | 18 | 30 |
| Comparative Example 1 | (C) | 0 | 0 | 0.62 | 0.22 | 35 | 33 |

Coefficient of dynamic friction: The smaller, the better for smoothness.
$E_{1/2}$: Half value exposure: The smaller, the higher the sensitivity.
Vr: Residual potential: The smaller, the better the elctrical properties.
(Note 1): The proportion of polysiloxane moieties was determined by $^1$H-NMR and represented by wt. %.

TABLE 2

| | Structure of binder resin | Content of polysiloxane moieties as charged | Mv of binder resin (×10,000) | Coefficient of dynamic friction | Amount of abrasion (mg) |
|---|---|---|---|---|---|
| Example 6 | Blend product of (A)/(C) (50/50 w/w) | (A): 1.0 (C): 0 | A: 3.16 C: 2.82 | 0.37 | 12.6 |
| Comparative Example 2 | Blend product of (A)/(C) (50/50 w/w) | (A): 1.0 (C): 0 | A: 0.91 C: 2.82 | 0.28 | 16.1 |

As shown in Table 1, when the photoreceptor of the present invention is employed, it is possible to remarkably improve the smoothness of the photoreceptor surface while maintaining the electrical properties to be good, as compared with the conventional photoreceptor. Further, as shown in Table 2, when a resin having a large molecular weight is used, it is possible to obtain a photoreceptor having good smoothness and excellent abrasion resistance.

According to the present invention, it is possible to remarkably improve the smoothness and sliding property of the surface of an electrophotographic photoreceptor without adversely affecting the electrical properties, whereby scratches tend to be scarcely formed by a cleaning blade or a developer, and such is extremely effective for a long useful life of the photoreceptor. Accordingly, the photoreceptor of the present invention is useful for a high speed copying machine, a power saving copy machine or a printer.

What is claimed is:

1. An electrophotographic photoreceptor having a photosensitive layer containing a binder resin on an electroconductive substrate, wherein at least a part of the binder resin in the photosensitive layer is a polycarbonate resin having a structure of the following formula (1) as main repeating units and a structure of the following formula (2) at one or each terminal and having a viscosity-average molecular weight of from 10,000 to 300,000:

(1)

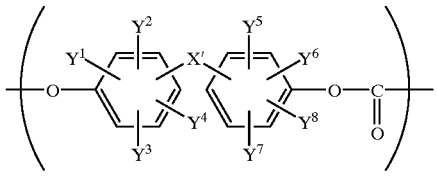

(2)

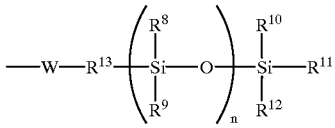

where, in the formula (1), each of $Y^1$ to $Y^8$ which are independent of one another, is a hydrogen atom, a $C_{1-10}$ saturated aliphatic hydrocarbon group, a $C_{3-10}$ unsaturated aliphatic hydrocarbon group, a halogen atom, a halogenated alkyl group, a $C_{1-10}$ alkoxy group or a $C_{6-20}$ aromatic hydrocarbon group which may be substituted, $X^1$ is

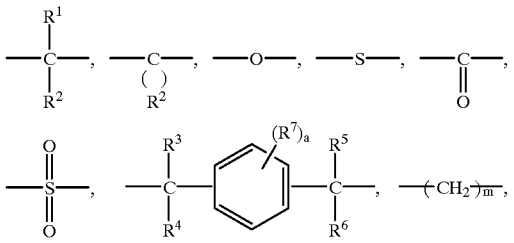

an aromatic ring, a single bond, a lactone or fluorene, each of $R^1$ to $R^7$ which are independent of one another, is a hydrogen atom, a $C_{1-10}$ saturated aliphatic hydrocarbon group which may have a substituent, a $C_{3-10}$ unsaturated aliphatic hydrocarbon group which may have a substituent, a halogen atom, an alkoxy group or a $C_{6-20}$ aromatic hydrocarbon group which may have a substituent, Z is a $C_{3-20}$ substituted or unsubstituted aliphatic hydrocarbon group, a is an integer of from 0 to 4, l is an integer of from 1 to 6, and m is an integer of from 2 to 20, and, in the formula (2), $R^{13}$ is an aliphatic and/or aromatic bivalent organic residue, W is a single bond, O, CO, COO, NH, NHCO, S, SO or $SO_2$, each of $R^8$ to $R^{12}$ which are independent of one another, is a $C_{1-10}$ saturated aliphatic hydrocarbon group which may have a substituent or a $C_{6-20}$ aromatic hydrocarbon group which may have a substituent, and n is an integer of from 1 to 500.

2. The electrophotographic photoreceptor according to claim 1, wherein the binder resin contains polysiloxane moieties (moieties having W and $R^{13}$ removed from the structure of the formula (2)) in an amount of from 0.01 to 5 wt %, based on the total binder resin contained in the photosensitive layer.

3. The electrophotographic photoreceptor according to claim 1, wherein the viscosity-average molecular weight is from 15,000 to 100,000.

4. The electrophotographic photoreceptor according to claim 1, wherein the structure of the formula (2) is a structure of the formula (2'):

(2')

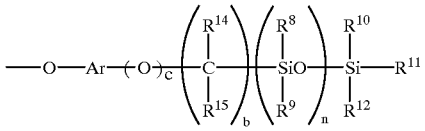

wherein each of $R^{14}$ and $R^{15}$ which are independent of each other, is a hydrogen atom, a $C_{1-18}$ saturated aliphatic hydrocarbon group, a $C_{3-10}$ unsaturated aliphatic hydrocarbon group, a halogen atom, a halogenated alkyl group, an alkoxy group or a $C_{6-20}$ aromatic hydrocarbon group which may have a substituent, Ar is a bivalent or higher valent aromatic hydrocarbon group which may be substituted, b is an integer of from 1 to 20, c is 0 or an integer of at least 1, and $R^8$ to $R^{12}$ and n are as defined above.

5. The electrophotographic photoreceptor according to claim 1, wherein the structure of the formula (2) is a structure of the formula (2"):

(2)"

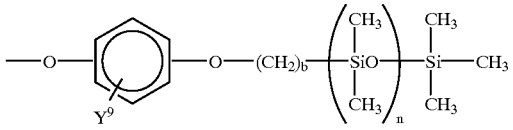

wherein $Y^9$ is a hydrogen atom, an alkyl group, an alkoxy group, a carbonylalkyl group, a phenyl group, an oxyphenyl group or a carbonylphenyl group, and n and b are as defined above.

6. The electrophotographic photoreceptor according to claim 1, wherein the structure of the formula (1) is a structure of the formula (1'):

(1')

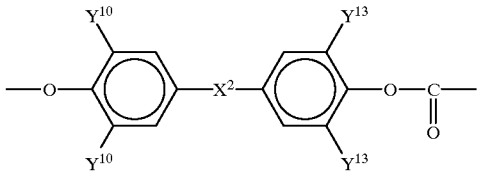

wherein each of $Y^{10}$ to $Y^{13}$ which are independent of one another, is a hydrogen atom, a $C_{1-4}$ alkyl group, a halogen atom or a phenyl group, and $X^2$ is

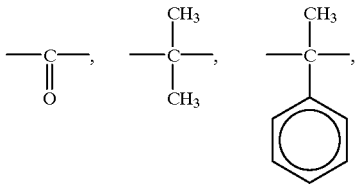

or

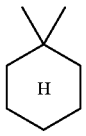

.

7. The electrophotographic photoreceptor according to claim 1, wherein the repeating units of the formula (1) of the polycarbonate resin are copolymer components of the following formulae (1a) and (1b):

(1a)

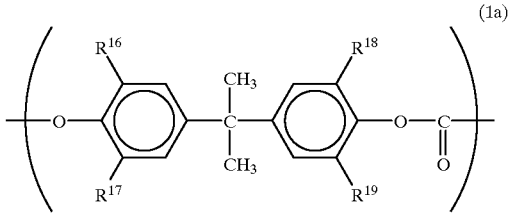

-continued (1b)

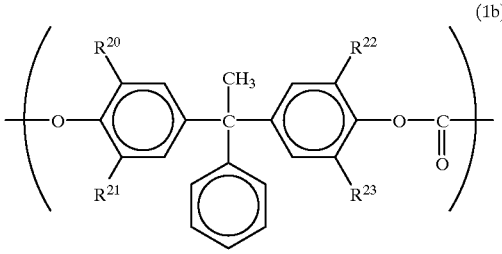

wherein each of $R^{16}$ to $R^{23}$ which are independent of one another, is a hydrogen atom or a $C_{1-4}$ alkyl group, provided that at least one of $R^{16}$ to $R^{19}$ is not a hydrogen atom.

8. The electrophotographic photoreceptor according to claim 1, wherein the polycarbonate resin having the structure of the formula (2) at the terminal, is contained in the surface layer of the photoreceptor.

9. The electrophotographic photoreceptor according to claim 1, wherein at least a charge generation layer and a charge transport layer are laminated in this order on the electroconductive substrate, and the polycarbonate resin having the structure of the formula (2) at the terminal, is contained in the charge generation layer.

10. The electrophotographic photoreceptor according to claim 9, wherein the charge transport layer contains a triarylamine compound, a hydrazone compound, a stilbene derivative compound or a butadiene derivative compound, as a charge transport material.

11. The electrophotographic photoreceptor according to claim 9, wherein the charge transport layer further contains a hindered phenol compound or a hindered amine compound.

* * * * *